United States Patent [19]

Vaught

[11] Patent Number: 4,930,053

[45] Date of Patent: May 29, 1990

[54] ELECTRICALLY LIGHTED ORNAMENT

[76] Inventor: Michael Vaught, 28 Windmill Rd., Armonk, N.Y. 10504

[21] Appl. No.: 292,427

[22] Filed: Dec. 30, 1988

[51] Int. Cl.[5] ..... F21P 1/02

[52] U.S. Cl. ..... 362/121; 362/301; 362/807

[58] Field of Search ..... 362/121, 301, 345, 346, 362/806, 807

[56] References Cited

U.S. PATENT DOCUMENTS 1,684,922 9/1928 Mammen ..... 362/121

2,199,435 5/1940 Koonz ..... 362/121

2,653,216 9/1953 Protz ..... 362/121

*Primary Examiner*—Stephen F. Husar

*Attorney, Agent, or Firm*—Edward B. Hunter

[57] ABSTRACT

A hollow ornament having a front wall and a back wall, the back wall and front wall being peripherally coextensive, joined at selected peripheral locations and providing peripheral apertures between the locations of joinder, at least the inner surfaces of the front and rear walls being light reflective, a light source within the ornament and means mounted the light source.

4 Claims, 2 Drawing Sheets

ELECTRICALLY LIGHTED ORNAMENT

BACKGROUND OF THE INVENTION

Lighted ornaments, particularly star-shaped Christmas tree or other type seasonal ornaments and displays are known in the prior art as disclosed, for example, in U.S. Pat. Nos. to Cowles, 1,543,424, Graf 2,155,822, Margolis et al 2,535,219, Raymond 2,659,993, Gunbaum 2,794,284, Charchman et al 3,272,976 and Duncan 4,523,260.

These prior art lighted ornaments cover the light source or sources with transparent or translucent covers so as to illuminate the ornament from within or to create a halo effect behind the ornament or to illuminate the front of the ornament. Some, like Charchman et al and Duncan provide shapes such as pointed or star shapes, to the tips or valley portions of which lamp mountings are provided.

THE INVENTION

It is the aim of the present invention to provide apertures along selected portions of the periphery of a hollow ornament, through which radiant light from an internally mounted light source emanates so that the illumination of and reflection from the inside surfaces of the ornament and of the edges of the apertures are perceived and an aura or halo of light is reflected in the ambient air at the apertured edges.

The invention also contemplates the use of a colored light source and/or light filters mounted near and about the apertures so that the lighted areas are perceived in color.

While in one preferred embodiment of the invention the hollow ornament is fabricated of opaque material, preferably metal such as copper or brass or from anodized sheet material so that the inner surfaces of the ornament are reflector surfaces, the invention also contemplates the use of translucent materials so long as the direct and reflected light to and from the lighted areas of the inside surfaces and peripheries of the apertures are seen.

It will be appreciated that where the outer surface is metallic; i.e., reflective and opaque, that a star-shaped ornament, particularly adapted for mounting atop a Christmas tree, will pick up the light from the tree beneath, as well as the ambient lighting to reflect the same while at the same time providing the lighted peripheral areas about the apertures, at the tips and or valleys of the star-shaped ornament.

In another embodiment of the invention, slotted areas preferably placed symmetrically, centrally in front of the ornament permit further radiant light emission forwardly of the ornament.

DESCRIPTION

Figure 1:
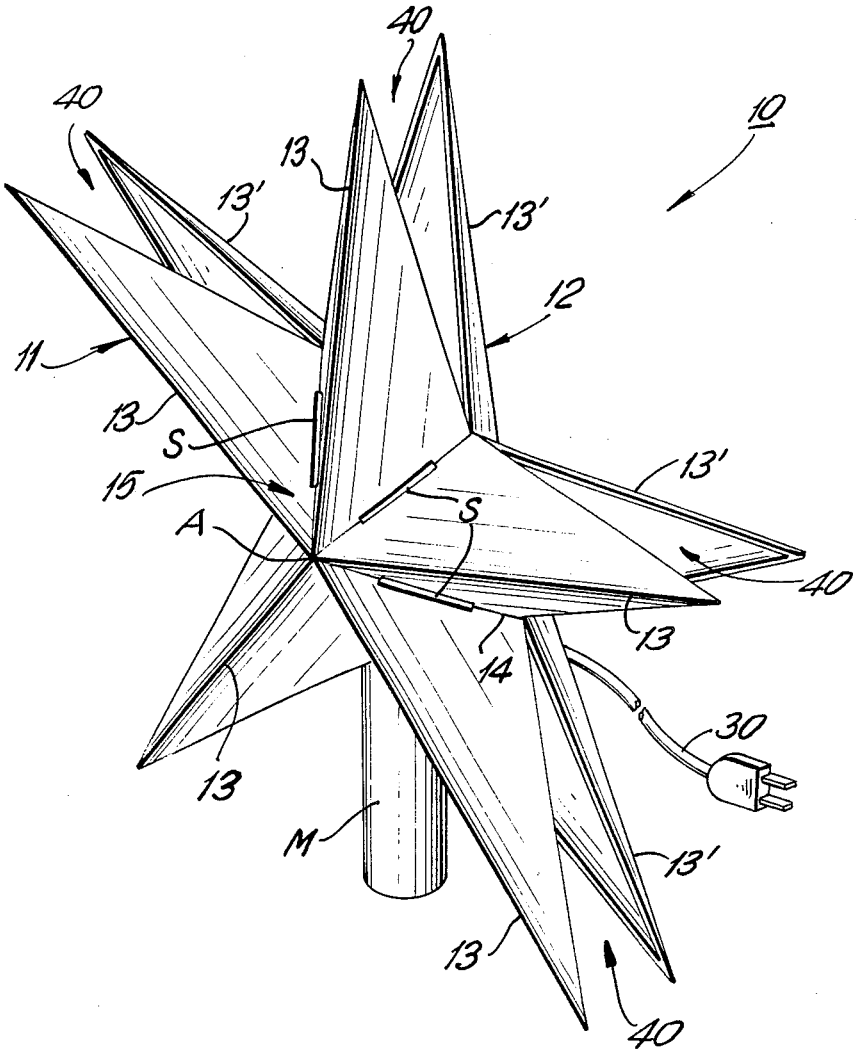
FIG. 1 is a perspective view of a star-shaped ornament incorporating the invention.

The star-shaped ornament 10 of the figures is fabricated from sheet material and is hollow, having front 11 and rear 12 halves, and each half comprises a three-dimensional star-shaped wall having five points 13, 13' each with inwardly diverging point walls extending from a peak or fold line which extends radially from the central star axis A, and five valleys 14, 14' surrounding a central body 15.

In the embodiment shown in the drawings, a lamp mounting 20 for an illuminating lamp 21 is positioned so as to center the lamp 21 in the center of the hollow body of the ornament. The mounting in this instance comprises a lamp socket into which the lamp is screwed in a conventional manner. An electric power line 30 extends from the mounting for connection to a power source, not shown. The mounting is secured at the top of a tube M by press fit but may, of course, be secured in any number of conventional ways. The tube M is a mounting for the ornament, in this instance, shaped to fit the upwardly extending limb at the top of a Christmas tree, and is secured by any conventional means at its top to the lowermost valley of the star-shaped ornament; e.g., glue, weld, tab and slot, thread, etc.

Figure 2:
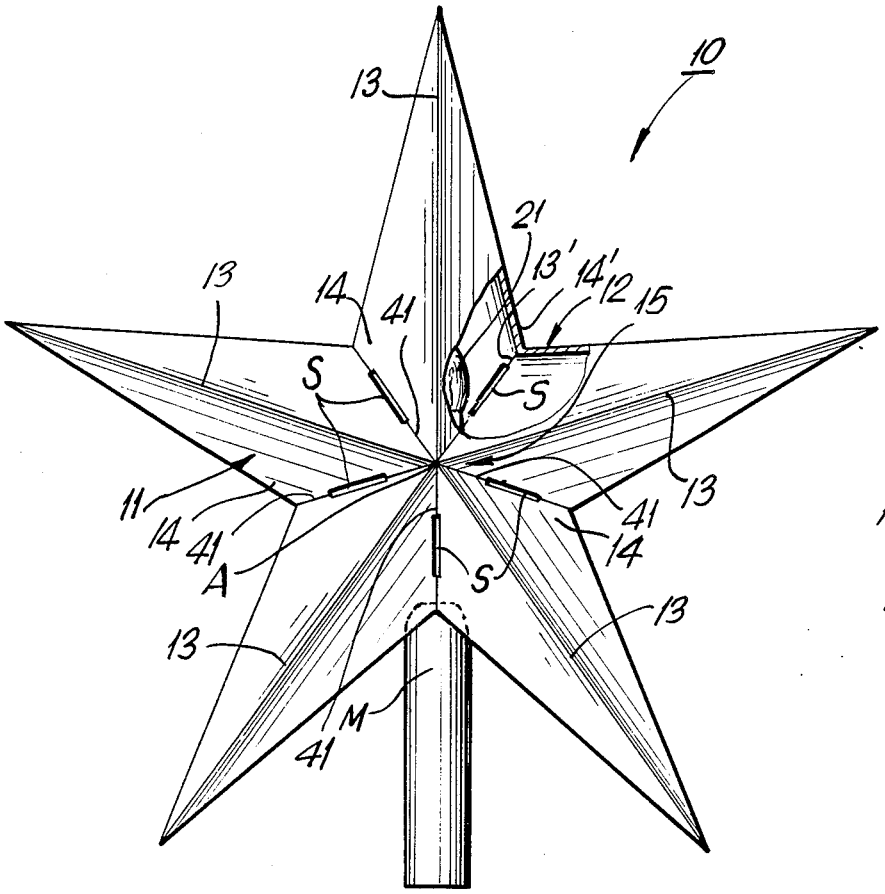
FIG. 2 is a front elevational view of the ornament of FIG. 1 partially broken away to show the back wall of the ornament.
Figure 3:
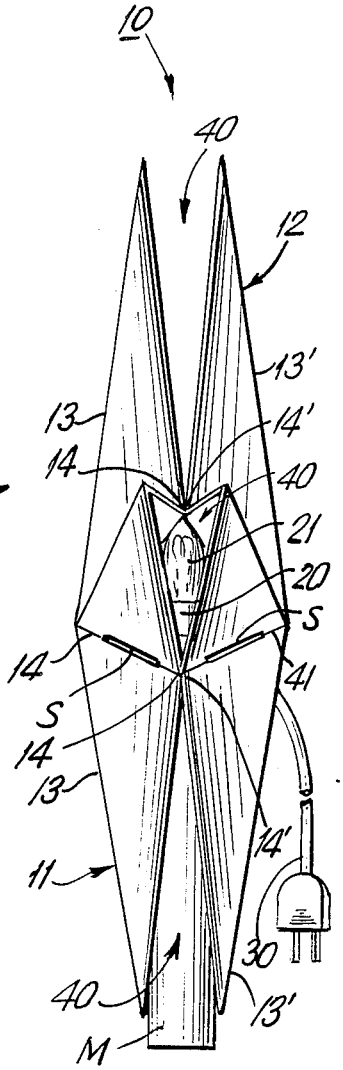
FIG. 3 is a side elevational view of the ornament of FIGS. 1 and 2.

In accordance with the invention, each point of the star-shaped ornament provides an opening 40, formed in the present instance between the diverging perpheries of the front and rear halves along the edges of the points of the star. In an optional embodiment of the invention, slots S may be provided along valley areas 41 on the faces of three-dimensional front wall 11 and along the valley areas on the face of the back wall as shown in FIG. 2.

It is contemplated that both the inner and outer surfaces of the hollow ornament are reflective surfaces, which includes mat white to shiny white and other colors, as well as the more reflective metallic surfaces.

When the lamp is lit, it can now be appreciated that the radiant light from the lamp strikes and is reflected from the variously angled inner surfaces of the hollow ornament adjacent the openings and is perceived by the viewer as both an outline of light and as an aura or halo of light as the reflection of the light from the juxtaposed inner surfaces angles outwardly of the aperture both to the rear of the ornament and to the front of the ornament. When viewed from an off-center position, more of the reflected light from the inner surfaces is seen and an attractive asymmetrical lighting effect is seen.

The optional slots in the front wall, when provided, also permit radiant light to emanate through the slots together with light reflected from the variously angled rear wall surfaces of the ornament.

The invention is not to be restricted to the specific embodiments disclosed, but rather to the scope of the claims which follow.

I claim:

1. A hollow ornament having a front wall and a back wall, the back wall and front wall being peripherally coextensive, joined at selected peripheral locations and providing peripheral apertures between the locations of joinder, at least the inner surfaces of at least one of said front and rear walls being light reflective, and means for mounting a light source within the ornament, an inner surface of said at least one of said front and rear walls being positioned relative to said mounting means so as to comprise means for reflecting light from a light source mounted in said mounting means through said peripheral apertures at non-radial angles.

2. A hollow ornament having a front wall and a back wall, the back wall and front wall being peripherally coextensive, joined at selected peripheral locations and providing peripheral apertures between the locations of joinder, at least the inner surface of the front and rear walls being light reflective, means for mounting a light source within the ornament, and wherein each of said front and rear walls are fabricated of sheet material, are star-shaped, the points and body of which provide inner and outer surfaces angled from peak lines extending radially from the star axis, and said selected joined locations are located a the valleys between the points.

3. The ornament of claim 2, wherein said means for mounting said light source includes a tube extending from between two points of the star-shaped walls, said tube also comprising means for mounting the element.

4. The ornament of claim 2, wherein a front wall of said ornament is slotted along radial planes.

* * * * *